United States Patent [19]

Gagnebin

[11] 4,368,992

[45] Jan. 18, 1983

[54] RIBBON CASSETTE FOR TYPEWRITER WITH TENSION PRODUCING LOCKING DEVICE

[75] Inventor: Gustave Gagnebin, Yverdon, Switzerland

[73] Assignee: Hermes Precisa International, Yverdon, Switzerland

[21] Appl. No.: 300,679

[22] Filed: Sep. 9, 1981

[30] Foreign Application Priority Data

Oct. 9, 1980 [CH] Switzerland ..... 7534/80

[51] Int. Cl.[3] ..... B41J 32/00

[52] U.S. Cl. ..... 400/196

[58] Field of Search ..... 400/194–196.1, 400/207, 208

[56] References Cited

U.S. PATENT DOCUMENTS

| | | | |
|---|---|---|---|
| 2,755,905 | 7/1956 | Segui | 400/196 |
| 2,904,157 | 9/1959 | Smith | 400/194 X |
| 3,311,316 | 3/1967 | Williams | 400/196 X |
| 3,995,731 | 12/1976 | Miller et al. | 400/196 X |
| 4,156,573 | 5/1979 | Anderson et al. | 400/196 |
| 4,175,877 | 11/1979 | Randolph | 400/196 |
| 4,269,520 | 5/1981 | Gabler | 400/196 |
| 4,317,636 | 3/1982 | Hume | 400/196 |

*Primary Examiner*—E. H. Eickholt

*Attorney, Agent, or Firm*—Emory L. Groff, Jr.

[57] ABSTRACT

A cassette comprises a casing (1) containing a delivery spool (2) and a receiving spool (4) co-operating with drive means. The ribbon (3) passes from the delivery spool (2) to the receiving spool (4) outside the casing (1). The delivery spool (2) is secured to a toothed wheel (20) which co-operates with a catch (23) of a part (21) biased by a spring (28). This part (21) in the form of a T, is pivotally mounted on the casing (1) at one of the upper ends of the arm or crosspiece of the T and carries return roller (24) at the other end of this arm around which roller the ribbon (3) is diverted in a manner to form a loop. The length of the upper arm of the part (21) is substantially twice as large as the distance separating the catch (23) of the pivot point of the part (21). This arrangement ensures a correct tension of the ribbon (3) at all times.

4 Claims, 2 Drawing Figures

RIBBON CASSETTE FOR TYPEWRITER WITH TENSION PRODUCING LOCKING DEVICE

Figure 1:
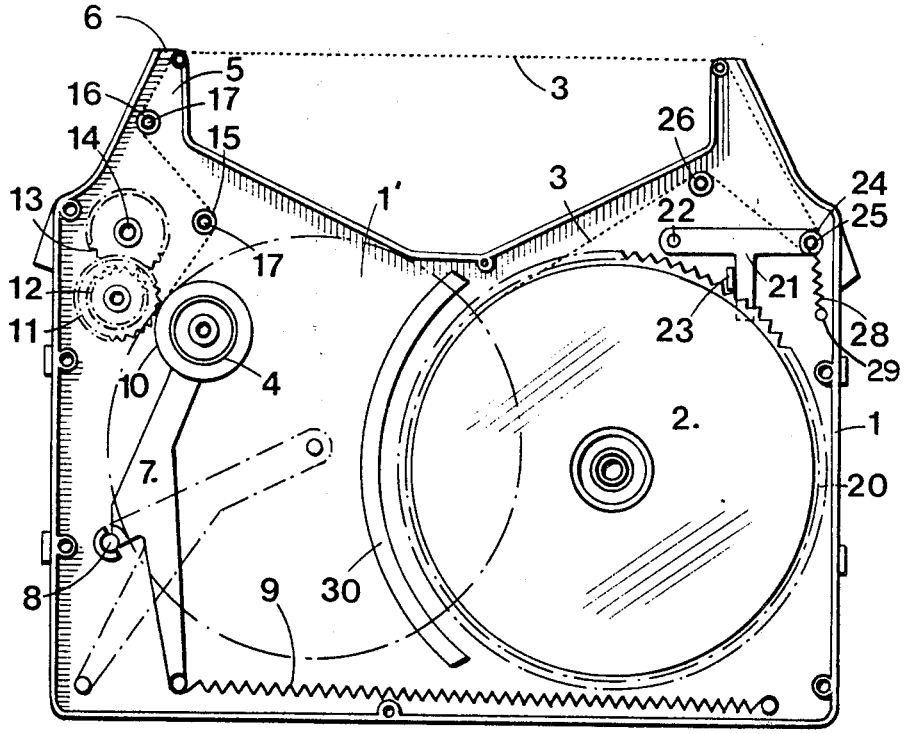

The present invention concerns a printing typewriter ribbon cassette having a casing enclosing a delivery spool on which the ribbon is wound, a receiving spool co-operating with drive means and adapted to receive the used ribbon, the printing ribbon passing from the delivery spool to the receiving spool following a path wherein a part of which passes outside the casing, means being provided to produce a tension in the ribbon between the two spools which means comprise an angular locking device for the delivery spool.

Ribbon cassettes of this type are known which comprise a spring steel thread one end of which is anchored in the casing, whilst the other end is folded at a right angle and extends parallel to the axis of the delivery spool to co-operate with the toothing of a toothed wheel secured to this spool. The printing ribbon forms a loop passing around the folded end of the spring steel thread before emerging from the casing. When the ribbon is stretched by the drive means operating on the receiving spool, the tension of the ribbon in the loop tends to disengage the folded end of the thread out of the toothing of the wheel. The delivery spool can then turn and the ribbon unwinds from this spool as long as the driving means are active. When the driving means stops, the folded end of the spring steel thread engages in the toothing of the wheel under the effect of its own elasticity and stretches the ribbon while operating on the loop.

The course of the free end of the spring steel thread is substantially equal to the depth of the toothing of the wheel. This course is insufficient for ensuring a correct tension of the ribbon, in particular when this latter is entrained in jerks.

It is an object of the invention to provide a typewriter ribbon cassette having means for tensioning the ribbon which are more effective than those existing in known cassettes.

According to the present invention a typewriter ribbon cassette comprises a casing enclosing a delivery spool on which a ribbon is wound, a receiving spool co-operating with drive means and adapted to receive the used ribbon, the ribbon in passing from the delivery spool to the receiving spool follows a path wherein a part thereof extends outside the casing, means being provided to produce a tension in the ribbon between the two spools with said means comprising an angular locking device for the delivery spool, characterised in that the locking device comprises a lever pivoted to the casing and presenting a locking catch adapted to engage between the teeth of a toothed wheel angularly secured with the delivery spool, said locking lever being biased by the action of an elastic force to engage its catch in the toothing, said lever carrying a pulley over which passes a loop formed by the printing ribbon which loop is guided in such a manner that the tension of the ribbon operates in the opposite direction to the elastic force for disengaging the catch from the toothing, the arm of the lever between the pivot point and the pulley being greater than the arm of the lever between this point and the said beak.

The invention will be described further, by way of example, with reference to the accompanying schematic drawings, in which:

FIG. 1 is an elevation of a printing ribbon cassette wherein the casing has been opened so as to show the different elements constituting the cassette;

and

Figure 2:
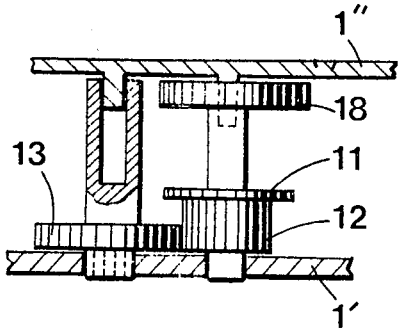

FIG. 2 is an enlarged fragmentary section of a detail of the cassette.

A typewriter ribbon cassette comprises a housing or casing 1 which contains a delivery spool 2 on which a printing or typewriter ribbon 3 is wound and a receiving spool 4 around which used ribbon is wound.

Part of the trajectory or path of the ribbon 3 between the delivery spool 2 and the receiving spool 4 is outside the casing 1. To this end, the casing 1 presents two extensions 5 the ends of which are open and form passages 6 for the ribbon 3. The portion of the ribbon 3 which is found outside the casing 1 between the two passages 6 is adapted to be engaged in a ribbon guide (not shown) of a typewriter provided to receive the cassette.

The receiving spool 4 is carried by an arm 7 pivotally mounted on a pivot 8 and biased by a spring 9 in a manner to bring periphery 10 of the spool 4 against a drive pulley 11. Pulley 11 carries a toothing co-operating with the outer turn of the ribbon 3 wound on the spool 4. As shown in FIG. 2, the pulley 11 is mounted on a shaft rotatably mounted between the base 1' and the cover 1'' of the casing 1 and is secured to a pinion 12 and a serrated wheel 18. The pinion 12 meshes with a pinion 13 secured to a motor shaft 14 one end of which extends through the base 1' of the casing 1 to be accessible from the outside. This end presents coupling means constituted by a hollowed out cross, adapted to co-operate with corresponding coupling means forming part of a typewriter adapted to receive the cassette.

The serrated wheel 18 partially protrudes through the casing 1 through an opening (not shown) of said casing and permits manual movement of the ribbon 3. The ribbon 3 engages between the spool 4 and the pulley 11 along a direction substantially perpendicular to a straight line joining the axis of rotation of these two latter parts. The ribbon 3 is guided in the appropriate direction from the passage 6 by two rollers 15, 16 rotatable about studs 17 integral with the base of the casing 1.

The delivery spool 2 is secured to a toothed wheel 20 and rotates freely around an axle secured to the casing 1.

A T-shaped lever 21 is pivoted at one end of its transverse branch on a stud 22 secured to the casing 1. The vertical branch of the T of this lever 21 has in its medial part a retaining catch formed by a fold 23 co-operating with the toothing of the wheel 20. The other end of the upper branch or crosspiece of the T of the lever 21 carries a spindle 25 for a tensioning pulley 24. The ribbon 3 passes around the pulley 24 between a return pulley 26 and the passage 6 of the casing and forms a loop guided obliquely with respect to the upper branch of the lever 21. The lever 21 is biased in the direction of the toothed wheel 20 by a spring 28 secured on the one hand on the spindle 25 and on the other hand, on a finger 29 secured to the casing 1.

The distance separating the axis of the pulley 24 and the stud 22 is greater, substantially by a ratio of two to one, than the distance separating the catch 23 from the spindle 22.

When the pinion 13 is driven by a typewriter mechanism, the pulley 11 rotates and winds the ribbon 3 around the spool 4. The delivery spool 2 being locked angularly, there results a supplementary tension in the ribbon 3 which pivots the lever 21 against the action of the spring 28. The delivery spool 2 can rotate when the catch 23 of the lever 21 is entirely disengaged from the toothing of the wheel 20. When the drive of the ribbon 3 ceases, the lever 21 biased by the spring 28, pivots in the direction of the toothed wheel 20 and the catch 23 engages in the toothing of the wheel 20. In pivoting, the lever 21 pulls on the ribbon 3 and this latter pivots the delivery spool 2 until the catch 23 comes into contact with the flank of a tooth of the wheel 20.

The ratio between the length of the pulled ribbon and the corresponding lowering of the beak being in the region of three to one, taking into account the angle which the loop of the ribbon 3 makes with the upper part of the lever 21, the catch 23 never descends to the base of the toothing of the wheel 20. That is to say that the spring 28 always operates on the lever 21 against the action of the tension of the ribbon 3 and permanently ensures a minimum tension in said ribbon.

The lever 7 and the spool 4 have been represented in broken lines in FIG. 1 in the position which they occupy when the ribbon 3 is entirely wound around the spool 4. It can be seen that the spool 4 is located partially above the toothed wheel 20. So as to prevent the spool 4 from engaging in the toothing of the wheel 20, the base of the casing 1 is provided with an inclined plane 30 projecting from the inside of the cassette and elevating the spool 4.

The cassette described above is provided for receiving several types of inked ribbons, ribbons carrying a deposit of carbon powder or ribbons, so called "long-life" ribbons, with which it is possible to type a character over a place which has already been used. The advance of the ribbon adapted for a long life ribbon is two to four times smaller than the advance of a conventional carbon powder ribbon.

Thanks to the construction of the cassette described above, it is possible to adapt the advance of the ribbon to the type of ribbon used by mounting in the casing 1 a drive shaft 14 and a carrying shaft for the pulley 11 provided respectively with pinions 12, 13 the transmission ratio of which is adapted to the desired ribbon advance. This arrangement avoids having to provide a typewriter with a ribbon regulating advance device and avoids moreover, all risk of error in the regulation of this advance device in the case of change of the type of ribbon.

I claim:

1. A typewriter ribbon cassette for a typewriter, comprising a casing enclosing a delivery spool on which a ribbon is wound, a receiving spool co-operating with drive means and adapted to receive the used ribbon, the ribbon in passing from the delivery spool to the receiving spool following a path wherein a part thereof extends outside the casing, means provided to produce a tension in the ribbon between the two spools, said means comprising an angular locking device for the delivery spool, characterized in that the locking device comprises a locking lever pivoted on the casing and including a locking catch adapted to engage between the teeth of a toothed wheel angularly secured with the delivery spool, said locking lever being biased by the action of spring means exerting an elastic force thereon to engage said locking catch in the teeth of said toothed wheel, a pulley on said locking lever over which passes a loop formed by the printing ribbon, guide means for said loop comprising a return pulley on said casing and passages in the open ends of oppositely disposed extensions of said casing whereby said loop is guided in such a manner that the tension of the ribbon operates in the opposite direction to the elastic force for disengaging the catch from the toothing, the arm of the locking lever between the pivot point and the pulley on said locking lever being greater than the distance of the arm of the lever from said pivot point and said catch.

2. A cassette according to claim 1, wherein the lever is T-shaped and is pivotally mounted on the casing at one of the ends of the crosspiece of the T while it carries the pulley at the other end of the crosspiece, the vertical band of the T presenting a fold constituting the catch co-operating with the teeth of the wheel.

3. A cassette according to claim 2, wherein the receiving spool is pivotally mounted on an arm spring biased in a manner to bring the periphery of this spool against a toothed drive pulley, characterised in that the casing of the cassette comprises returns guiding the used ribbon towards the receiving spool in accordance with a direction substantially perpendicular to a line joining the axes of rotation of the receiving spool and the drive pulley.

4. A cassette according to claim 3, wherein the drive pulley is carried by a shaft provided with a toothed wheel in mesh with another toothed wheel secured to a drive control shaft presenting coupling means accessible from outside the casing, one of the walls of the casing being removable for permitting the extraction of these two shafts for replacement by two other shafts provided with toothed wheels giving a different transmission ratio.

* * * * *